US005752766A

United States Patent [19]

Bailey et al.

[11] Patent Number: 5,752,766

[45] Date of Patent: May 19, 1998

[54] MULTI-COLOR FOCUSABLE LED STAGE LIGHT

[76] Inventors: James Tam Bailey, 1613 Pleasant Run, Carrollton, Tex. 75006; Phillip L. Scheldt, 6319 Turner Way, Dallas, Tex. 75230

[21] Appl. No.: 814,667

[22] Filed: Mar. 11, 1997

[51] Int. Cl.[6] ..... F21V 21/14

[52] U.S. Cl. ..... 362/250; 362/231; 362/285; 362/800

[58] Field of Search ..... 362/240, 231, 362/285, 286, 418, 800, 250

[56] References Cited

U.S. PATENT DOCUMENTS

| | | | |
|---|---|---|---|
| 4,025,777 | 5/1977 | Hayakawa | 362/250 |
| 4,727,289 | 2/1988 | Uchida | 315/71 |
| 4,729,076 | 3/1988 | Masami et al. | 362/235 |
| 4,939,426 | 7/1990 | Menard et al. | 315/192 |
| 4,954,822 | 9/1990 | Borenstein | 340/925 |
| 4,963,798 | 10/1990 | McDermott | 315/312 |
| 4,965,488 | 10/1990 | Hihi | 313/499 |
| 5,036,248 | 7/1991 | McEwan et al. | 313/500 |
| 5,143,442 | 9/1992 | Ishikawa et al. | 362/253 |
| 5,400,229 | 3/1995 | Lin | 362/249 |
| 5,450,301 | 9/1995 | Waltz et al. | 362/231 |
| 5,561,346 | 10/1996 | Byrne | 313/512 |

*Primary Examiner*—Stephen F. Husar

*Attorney, Agent, or Firm*—Akin, Gump, Strauss, Hauer & Feld, L.L.P.

[57] ABSTRACT

A multi-color, focusable, lighting apparatus particularly adapted for illuminating performance stages and other visual displays comprises an array of light emitting diodes (LEDs) supported on a flexible base member which in turn is supported by a housing of the apparatus. A linear actuator is operable to move the base member between a generally planar position and a deflected position to cause the LED array to change the direction of the optical axes of a substantial number of LEDs in the array to focus light emitted from the LEDs, respectively. The LEDs are preferably provided in clusters of three LEDs, each cluster including a red, blue and green LED. A generally cylindrical shield may be connected to the housing to project light from the apparatus. The base member may comprise a moldable polymer material wherein the LED array and electrical conductors are encapsulated in the base member itself.

19 Claims, 2 Drawing Sheets

MULTI-COLOR FOCUSABLE LED STAGE LIGHT

FIELD OF THE INVENTION

The present invention pertains to a light source comprising and array of multi-color light emitting diodes (LEDs) wherein the array is mounted on a flexible diaphragm-like support structure which may be deflected to focus a beam of variable colored light. The light source is particularly adapted for use in performance stage or other visual display lighting applications.

BACKGROUND OF THE INVENTION

Light emitting diodes (LEDs) have found commercial success in many requirements for light sources including individual signal or indicator lights and in arrays of multiple LEDs for both indoor and outdoor signal and indicator lighting applications. Large arrays of LEDs have also been developed for various types of graphic displays, including indoor and outdoor advertising and information displays as well as large scale video displays. The relatively low power consumption, long service life and reliability of light sources made up of LEDs has contributed to their success in the above mentioned applications.

Another application wherein, according to the present invention, light emitting diodes may be used advantageously is with regard to lighting for performances stages and other visual displays which require, or desirably should have, variable color and intensity of light as well as selective concentration or focusing of light on particular areas of the display or the stage. Heretofore, high intensity incandescent lights have been used, particularly, for stage lighting. Such lights require multi-color mechanical/optical filter devices to effect changes in projected light color. However, the range of colors of such light sources is somewhat limited and the power requirements for such lights is substantial.

The efficiency and reliability of light emitting diodes for lighting applications of the type described above can be advantageous and, in particular, by providing light sources comprising arrays of LEDs of certain primary colors, for example, which may be controlled selectively to be "on" or "off" or be "on" at a certain intensity, a wide range of colors and light intensities is possible. An LED light source or light apparatus in accordance with the present invention substantially meets the desiderata and requirements of performance stage and visual display lighting mentioned above as will be appreciated by those skilled in the art from the following summary and detailed description of the invention.

SUMMARY OF THE INVENTION

The present invention provides an improved light source or lighting apparatus, particularly adapted for use in performance stage lighting and other visual display lighting applications.

In accordance with an important aspect of the invention a lighting apparatus is provided which is characterized by an array of light emitting diodes (LEDs) which are provided in a pre-determined pattern of selected colors and which may be controlled to provide a wide variety of color lighting projected by the array.

In accordance with another important aspect of the invention a lighting apparatus is provided wherein an array of LEDs is supported on a flexible base or support structure which may be selectively deflected to effect focusing of a light beam generated by the multiple LEDs of the array. The support base for the LED array may comprise a flexible elastomeric member which may include suitable circuitry mounted thereon or embedded therein for providing electrical signals to each LED of the array. The flexible support base is operably connected to an actuator which may be controlled to deflect the base to change the directional characteristics of light beams being projected by each LED so that the resultant or collective light beam generated by the apparatus may be focused or concentrated on a target distant from the apparatus.

In accordance with further aspects of the present invention an improved multi-color high intensity stage light apparatus is provided utilizing a large array of LEDs and wherein the apparatus may be configured to replace conventional incandescent stage lighting devices. Still further, the invention contemplates the provision of a lighting apparatus which includes a housing for supporting a flexible support or base member for a large array of LEDs and wherein certain control components for energizing and controlling the LED array, such as electrical control circuitry and voltage conversion or rectifier devices may be mounted on the housing and easily replaced when defective or in need of repair.

Those skilled in the art will further appreciate the above-mentioned advantages and superior features of the invention upon reading the detailed description which follows in conjunction with the drawing.

DESCRIPTION OF THE PREFERRED EMBODIMENT

Figure 3:
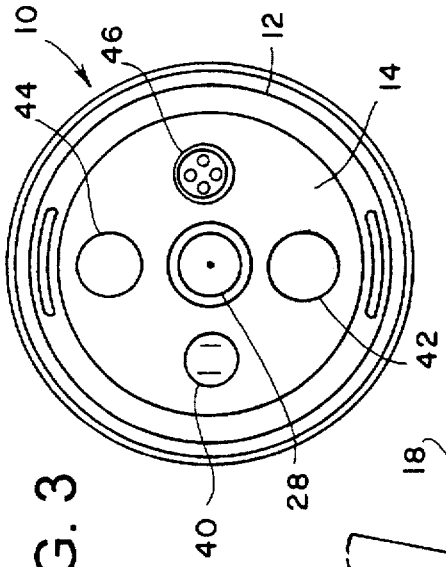
FIG. 3 is an elevation of the opposite end of the apparatus shown in FIGS. 1 and 2.

In the description which follows like elements are marked throughout the specification and drawing with the same reference numerals, respectively. The drawing figures are not necessarily to scale and certain elements may be shown in generalized or schematic form in the interest of clarity and conciseness.

Figure 1:
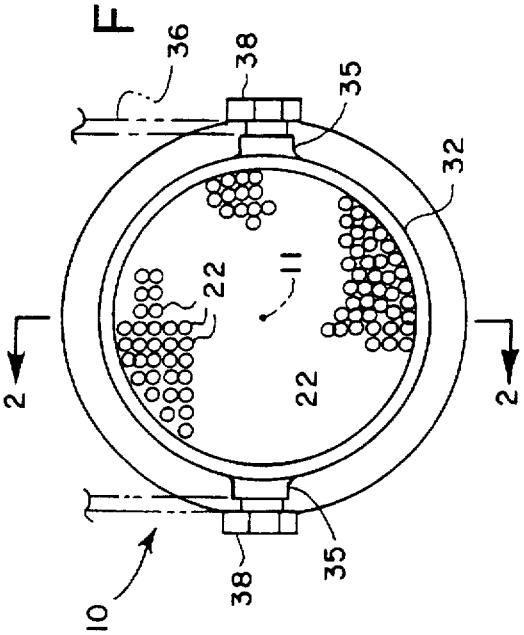
FIG. 1 is an end elevation of a multi-color, focusable light apparatus in accordance with the invention.
Figure 2:
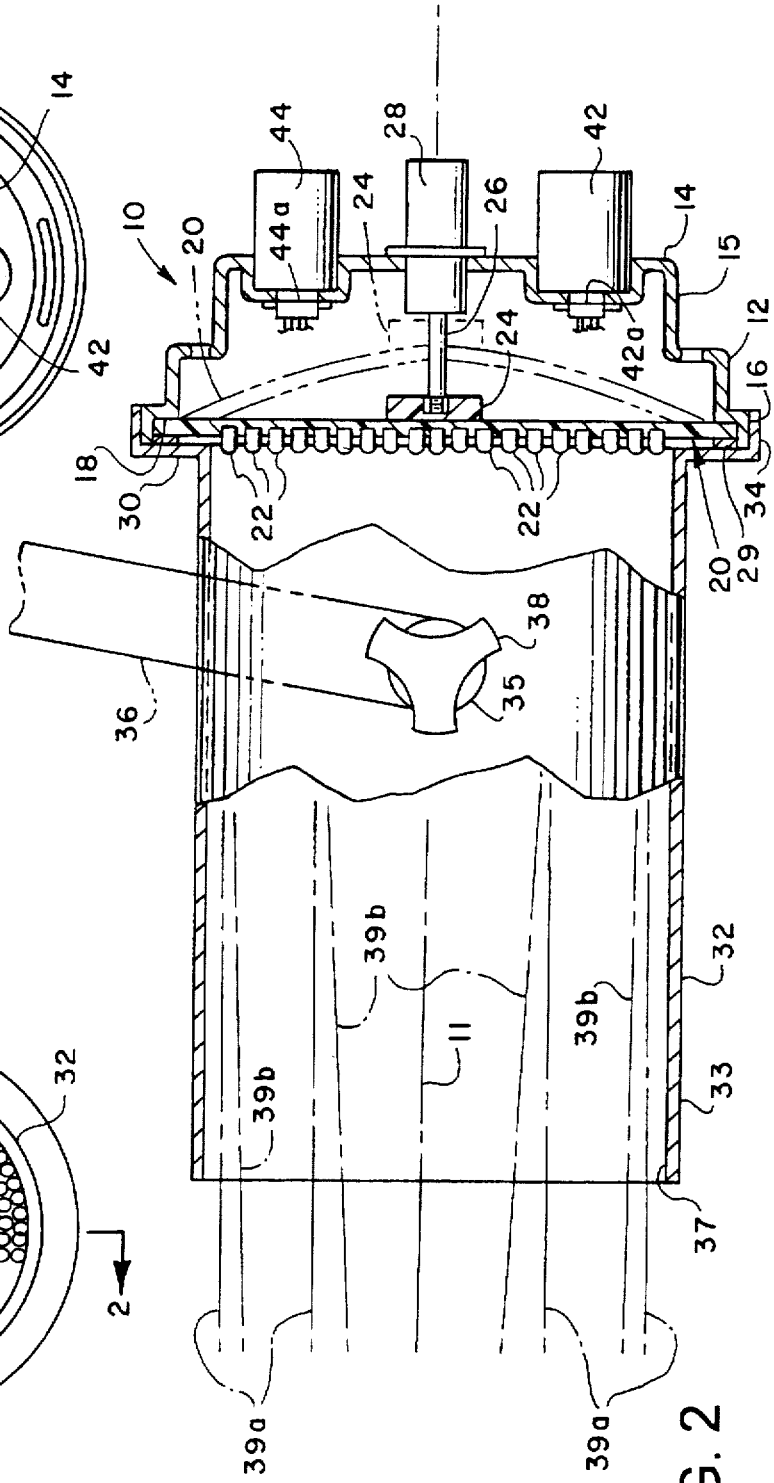
FIG. 2 is a longitudinal central section view of the apparatus taken from the line 2—2 of FIG. 1.
Figure 4:
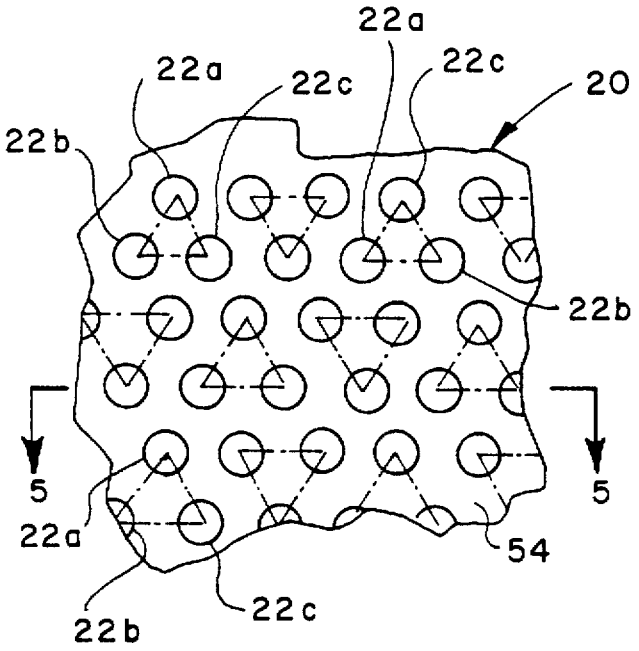
FIG. 4 is a detail plan view showing one preferred pattern of LEDs used in the array of the apparatus of the invention.

Referring primarily to FIGS. 1 and 2, a light source or apparatus in accordance with the invention is generally designated by the numeral 10. The light apparatus 10 comprises a generally cylindrical support housing 12 having a rear transverse wall 14, a generally cylindrical, stepped intermediate wall 15 and a circumferential flange 16 defining an annular recess 18. Recess 18 is adapted to support a generally circular, planar, relatively thin, flexible base or support member 20. The flexible base 20 is adapted to support an array of light emitting diodes (LEDs) 22 disposed spaced apart on the base 20 in a gridlike pattern, as indicated in FIGS. 1, and 4. The base 20 also includes a hub portion 24, FIG. 2, which may be integrally formed with or bonded to the base and which is suitably connected to an extensible rod 26 of a linear actuator 28. The actuator 28 is suitably mounted on the transverse wall 14 of the support housing 12.

The actuator 28 is operable to move the rod 26 in opposite directions along the central axis 11 of the apparatus 10 between a position as indicated the solid lines in FIG. 2 and a selected one of alternate working positions, a limit one of which is indicated by the alternate position lines in FIG. 2. The actuator 28 may comprise a solenoid type actuator or other suitable linear servo motor or actuator which may be controlled to deflect the flexible base 20 in such a way as to form a somewhat arcuate concave, surface of revolution shape as indicated by the one alternate position shown. The shape of the surface of revolution formed by the base member 20, in a deflected position, is preferably parabolic. Accordingly, the direction of light projected from the LEDs 22 may be altered to provide a somewhat focused beam directed to the centroid or focal point of the altered shape of the base 20.

The flexible base 20 may be suitably supported in the recess 18 by a ring-like retainer 29, which may be retained in its working position by suitable means, including for example, a flange 30 of a generally cylindrical elongated light shield or "can" 32 comprising part of the apparatus 10. An axially projecting collar portion 34 of the shield 32 is engageable with the flange 16 of the housing 12 and may be suitably secured thereto by means, not shown, to retain the apparatus 10 in assembly, as illustrated. Those skilled in the art will appreciate that the specific manner in which the flexible LED support base 20 is mounted in the housing 12 and cooperates with the light shield 32 may be modified without departing from the scope and spirit of the invention.

As further shown in FIGS. 1 and 2, the cylindrical can-like shield 32 may have opposed bosses 35 formed on the exterior thereof whereby the apparatus 10 may be suitably mounted on support structure, including a bail 36, in a conventional manner. Winghead screws 38 are operable to connect the bail 36 to the shield 32 and for adjusting the attitude of the axis 11 of the apparatus 10 with respect to the bail.

As shown in FIG. 2, the end of the shield 32 opposite the flange 30 is provided with a cylindrical opening 37 defined by the cylindrical tubular wall 33 of the shield for projecting substantially parallel light beams **39*a* therefrom, which light beams are generated by the LEDs 22 when the support base 20 is in the position shown by the solid lines in FIG. 2. However, the axes of the light beams being projected by the LED array may be altered to generally follow the beam path lines 39*b*, for example, which beam path lines converge toward each other when the base 20 is deflected to the position shown by the alternate position lines in FIG. 2**.

For applications of the apparatus 10 to replace convention incandescent stage lighting and similar lighting apparatus, the apparatus 10 is adapted to be connected to conventional connector means providing alternating current electrical power to the apparatus so that the apparatus may be easily substituted for conventional incandescent stage lights. As shown in FIG. 3, the housing 12 supports a conventional connector member 40 which may be connected to a conventional alternating current source of electrical energy, not shown.

Still further, the housing 12 is adapted to support plug-in type control elements, such as a voltage rectifier 42, see FIGS. 2 and 3, and other control elements indicated at 44, for example. The control elements 42 and 44 each include suitable releasable connectors **42*a* and 44*a*, respectively, wherein these elements may be quickly connected to or disconnected from the apparatus 10. A suitable control cable connector 46, FIG. 3, is also provided at the transverse rear wall 14 of housing 12 for connecting the apparatus 10 to a suitable controller, not shown, for varying the color and intensity of light emitted by the apparatus 10 and, of course, for varying the focus of the array of LEDs 22 by movement of the actuator 28 to deflect the flexible base 20. Remote control of the apparatus 10** is desirable for many lighting applications, including live stage performances, and certain types of visual displays.

Referring now to FIG. 4, a portion of the array of LEDs 22 is illustrated in plan view wherein the array preferably includes clusters of three LEDs **22*a*, 22*b* and 22*c*, each cluster being preferably arranged in a generally triangular or diamond shaped pattern. Each cluster preferably includes one red LED 22*a*, one blue LED 22*b* and one green LED 22*c*. When all LEDs 22*a*, 22*b* and 22*c* are illuminated at the same intensity substantially white light is emitted by the apparatus 10. Each of the LEDs 22*a*, 22*b* and 22*c* may be energized for selective periods of time and/or illuminated with different degrees of intensity in a known manner. Accordingly, the perceived color of light emitted from the apparatus 10 may be selectively varied over a wide range of colors. The particular orientation or position of each of the LEDs 22*a*, 22*b* and 22*c* in each cluster may be varied and a uniform color field of light projected by the apparatus 10 may be obtained in any case. The LEDs 22*a*, 22*b* and 22*c*** may be of types commercially available and of conventional construction.

Figure 5:
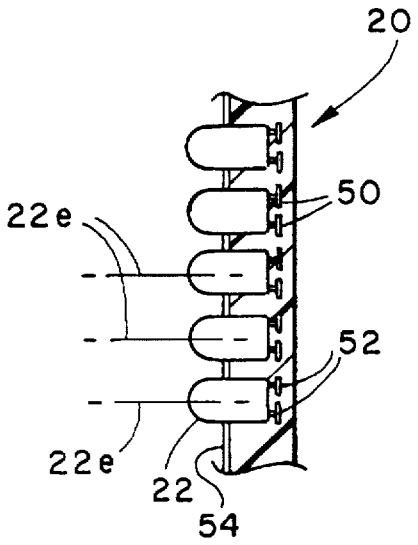
FIG. 5 is a detail section view taken along line 5—5 of FIG. 4 showing one preferred arrangement of mounting the individual LEDs on the flexible base.

Preferably, the LEDs, generally designated by the numeral 22, each include glass capsule structures, as illustrated, with suitable conductor means in the base of the capsule and the capsules are embedded in or molded into the flexible base member 20 or otherwise supported on the base in a preferred manner. Suitable conductor means may be "printed" on or embedded in the material of the flexible base 20, as indicated at numerals 50 and 52, for example, in FIG. 5. In other words, the LEDs 22 may be suitably engaged with their electrical conductors 50 and 52 and encapsulated in the material of the flexible base 20 at the time of manufacture. Each of the LEDs 22 also, preferably, includes an optical axis **22*e*, FIG. 5, representatives one of which are illustrated, which are aligned in generally parallel relationship with the axis 11 when the base 20 is in the position shown by the solid lines of FIG. 2. However, when the base 20 is deflected, as shown in FIG. 2, the optical axes 22*e* may be reoriented to provide the converging light beams indicated by lines 39*b* in FIG. 2. The LEDs 22 are preferably of a type having low light dispersion about their optical axes and preferably have an angle of light directivity of less than about thirty degrees with respect to the optical axes 22*e***, respectively.

The surface of the base 20 from which the LEDs 22 project may be suitably coated with a light reflective coating 54, as indicated in FIG. 5. The material composition of the base 20 may be a suitable polymer or elastomer material, such as vinyl, natural or synthetic rubber or another substantially heat resistant, flexible or stretchable polymer-like material which is substantially electrically nonconductive. In this way the base 20 may be elastically defected from the position indicated by the solid lines in FIG. 2 to a limit position indicated by the alternate position lines in FIG. 2 or to any position therebetween controlled by movement of the actuator 28.

Except as noted herein, the apparatus 20 may be constructed using conventional materials for high intensity lighting apparatus, such as stage lighting or spot lighting for visual displays of virtually any type. The LEDs **22*a*, 22*b* and 22*c* may be of a type commercially available and which are operable on continuous or pulsed voltages from zero volts DC to about fifteen volts DC. The LEDs 22** may have nominal diameters of from about 3.0 mm to about 10.0 mm, for example. Control circuits for energizing the respective LEDs may be provided in accordance with known methods and apparatus for LED displays and the like, for example.

The construction and operation of the apparatus 10 is believed to be within the purview of one of ordinary skill in the art from the foregoing description. Those skilled in the art will appreciate that a unique multi-color or so called "full" color high intensity lighting apparatus which is operable to focus or concentrate a light beam emitted therefrom is provided by the present invention and that various substitutions and modifications may be made to the embodiment described within departing from the scope and spirit of the appended claims.

What is claimed is:

1. An electrical light source characterized by an apparatus including an array of light emitting diodes (LEDs), said apparatus comprising:

a housing;

a flexible base member supported on said housing;

an array of LEDs supported on said base member and operable to be connected to a source of electric energy for generating light emitted therefrom; and an actuator connected to said base member and operable to move said base member to selected working positions to redirect light emitted by at least some of said LEDs.

2. The apparatus set forth in claim 1 including:

a shield operably connected to said housing and including an opening at one end for emitting light from said array of LEDs to be projected toward a target.

3. The apparatus set forth in claim 1 wherein:

said base member comprises a generally circular flexible member and said LEDs are mounted on said base member and project from a surface thereof.

4. The apparatus set forth in claim 3 wherein:

said LEDs each have an optical axis and said optical axis is substantially normal to said surface of said base member.

5. The apparatus set forth in claim 4 wherein:

said surface of said base member includes a light reflective coating disposed thereon.

6. The apparatus set forth in claim 3 wherein:

said actuator comprises a linear actuator operable to move said base member between a generally planar position wherein said LEDs project light in a direction generally along a central axis of said apparatus normal to said base member and a position wherein said base member has a generally arcuate surface of revolution shape whereby the optical axes of said LEDs are operable to project light along beam paths which converge toward each other.

7. The apparatus set forth in claim 1 including:

a rectifier circuit supported on said housing and releasably connected thereto by cooperable connector means.

8. The apparatus set forth in claim 1 including:

a control circuit mounted on said housing and releasably connected thereto by releasable connector means.

9. The apparatus set forth in claim 1 wherein:

selected ones of said LEDs are operable to emit light of different colors, respectively.

10. The apparatus set forth in claim 9 wherein:

said LEDs are arranged in clusters of three LEDs, each cluster comprising a red LED, a blue LED and a green LED.

11. A multi-color, focusable light apparatus adapted for illuminating at least one of a performance stage and a visual display, said apparatus comprising:

a support housing;

a generally cylindrical, flexible base member supported on said housing and moveable between selected working positions;

actuator means connected to said base member for moving said base member to said working positions;

an array of LEDs mounted on said base member and projecting from a surface of said base member, said LEDs being operable to emit light of at least two primary colors along an optical axis of said LEDs, respectively; and a generally circular shield disposed adjacent said array of LEDs for projecting light emitted from said LEDs toward said one of said stage and said visual display.

12. The apparatus set forth in claim 11 wherein:

said LEDs are provided in clusters of three LEDs, each cluster including a red LED, a blue LED and a green LED, respectively.

13. The apparatus set forth in claim 11 wherein:

said base member is formed of a flexible elastomeric material and said base member includes electrical conductor means disposed thereon for conducting electric energy to said LEDs, respectively.

14. The apparatus set forth in claim 13 wherein:

said conductor means are encapsulated in said base member.

15. The apparatus set forth in claim 13 wherein:

said LEDs are encapsulated in said base member.

16. A light apparatus adapted for illuminating at least one of a performance stage and a visual display, said apparatus comprising:

a support housing;

a generally cylindrical, flexible base member supported on said housing and operable to be deflected to selected working positions;

actuator means connected to said base member for moving said base member to said working positions;

an array of LEDs mounted on said base member, said LEDs being arranged in clusters of three LEDs, each cluster including a red LED, a blue LED and a green LED, respectively; and a shield disposed adjacent said array of LEDs for projecting light emitted from said LEDs toward said one of said stage and said visual display.

17. The apparatus set forth in claim 16 wherein:

said base member is formed of a flexible elastomeric material and said base member includes electrical conductor means disposed thereon for conducting electric energy to said LEDs, respectively.

18. The apparatus set forth in claim 17 wherein:

said conductor means are encapsulated in said base member.

19. The apparatus set forth in claim 17 wherein:

said LEDs are encapsulated in said base member.

* * * * *